United States Patent [19]

Barber et al.

[11] 4,305,834

[45] Dec. 15, 1981

[54] LUBRICATING COMPOSITION CONTAINING EMULSION-SLUDGE INHIBITORS

[75] Inventors: Rodney I. Barber, Bracknell; David K. Walters, Yateley, both of England

[73] Assignee: Ethyl Corporation, Richmond, Va.

[21] Appl. No.: 214,135

[22] Filed: Dec. 8, 1980

[30] Foreign Application Priority Data

Jan. 2, 1980 [GB] United Kingdom ..... 00103/80

[51] Int. Cl.[3] ..... C10M 1/32

[52] U.S. Cl. ..... 252/51.5 A; 252/51.5 R; 252/52 A; 252/52 R

[58] Field of Search ..... 252/51.5 A, 51.5 R, 252/52 A, 52 R

[56] References Cited

U.S. PATENT DOCUMENTS

| | | | |
|---|---|---|---|
| 2,734,088 | 2/1956 | Knowles et al. | 252/52 R X |
| 2,979,528 | 4/1961 | Lundsted | 564/443 X |
| 3,101,374 | 8/1963 | Patton, Jr. | 564/355 X |
| 3,509,052 | 4/1970 | Murphy | 252/51.5 A X |
| 3,928,219 | 12/1975 | Papay et al. | 252/51.5 R |
| 3,962,124 | 6/1976 | Motz et al. | 252/52 R |

*Primary Examiner*—Andrew Metz

*Attorney, Agent, or Firm*—Donald L. Johnson; John F. Sieberth; Joseph D. Odenweller

[57] ABSTRACT

A lubricating oil composition for use in the crankcase of an internal combustion engine, having improved resistance to the formation of emulsion-sludge in the area under the engine rocker cover, which contains the combination of an oxyalkylated alkylphenol-formaldehyde condensation product and tetra polyoxyethylene polyoxypropylene derivative of ethylene diamine.

12 Claims, No Drawings

LUBRICATING COMPOSITION CONTAINING EMULSION-SLUDGE INHIBITORS

BACKGROUND

Modern lubricating oils used in internal combustion engines contain dispersants. These prevent the accumulation of engine sludge. However, such dispersants are surface active agents, and it has been found that their use can lead to a phenomenon called "emulsion-sludge". This occurs in overhead valve engine including overhead cam engines on the engine parts under the rocker cover. Water can accumulate in this zone especially in cold weather and combine with engine oil to form a water-oil emulsion having the consistency of mayonnaise. Additives have been proposed to alleviate this problem. One such additive is described in U.S. Pat. No. 3,928,219.

SUMMARY

It has now been discovered that emulsion-sludge can be eliminated or the amount substantially reduced by including in the lubricating or motor oil the combination of an oil-soluble oxyalkylated alkylphenol-formaldehyde condensation product and an oil-soluble tetrapoly oxyalkylene derivative of ethylene diamine.

DESCRIPTION OF THE PREFERRED EMBODIMENT

A preferred embodiment of the invention is a lubricating oil composition comprising a major amount of lubricating oil and a minor emulsion-sludge inhibiting amount of the combination of (a) an oxyalkylated alkylphenol-formaldehyde condensation product and (b) a tetrapoly(oxyethylene)-poly(oxypropylene) derivative of ethylene diamine.

The oxyalkylated alkylphenol-formaldehyde condensation product preferably has the formula:

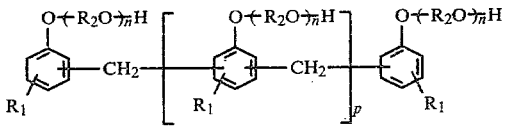

wherein $R_1$ is an alkyl group containing about 5 to 20 carbon atoms, $R_2$ is a divalent aliphatic hydrocarbon group containing 2 to 3 carbon atoms, the values of n are each independently from 1 to 20 and p is from 0 to about 20. More preferably, n is an integer from 2 to 10 and p is an integer from 7 to 12 such that the molecular weight is in the range of about 4000–6000.

In a still more preferred embodiment $R_1$ is the nonyl group. Most of the $R_1$ groups are bonded in the para position and the methylene bridges are between ortho positions. In the most preferred embodiment $R_2$ is the ethylene group —$CH_2$—$CH_2$— which is formed by oxyethylating the phenolic hydroxy groups by reaction with ethylene oxide.

Suitable oxyalkylated alkylphenol-formaldehyde condensation products are available commercially. One such preferred additive is marketed by Pierrefitte-Auby of Paris, France under the trade name "Prochinor GR 77". This product is supplied as a concentrate in an aromatic solvent. The active ingredient is believed to be an ethoxylated nonyl phenol-formaldehyde condensate of molecular weight 4200 (by gel permeation chromatography calibrated with polystyrene).

The tetra-poly oxyalkylene derivatives of ethylene diamine may have the general formula:

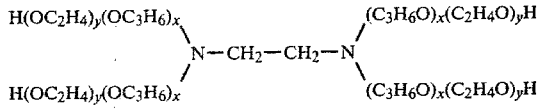

in which x and y, respectively, are integers which are so selected that the collective average molecular weight range of the poly(oxypropylene) hydrophobic blocks is between about 500 and 7000 and the poly(oxyethylene) hydrophilic blocks constitute from about 10 to 80 percent by weight of the total molecule. The alkylene oxide content of the hydrophobic blocks need not be pure propylene oxide nor must the hydrophylic blocks be pure ethylene oxide. Either can contain minor amounts up to about 5 weight percent of ethylene oxide or propylene oxide, respectively.

For the purposes of the present invention, it is preferred to use liquid or pasty poly(oxyethylene)-poly(oxypropylene) derivatives of ethylene diamine having the above formula. Especially preferred are those amine derivatives of the above formula which have a molecular weight of from 5000 to 12,500 and a poly(oxyethylene) content of from 10 to 40 percent.

More preferably preferred are those amine derivatives of the above formula which have a molecular weight of from 7000 to 10,000 and a poly(oxyethylene) content of from 10 to 20 percent. These are liquid or paste products which are readily soluble or dispersible in the lubricating oil base. These materials are known and may be produced by the process disclosed in U.S. Pat. No. 2,979,528.

Suitable tetra poly(oxyethylene)-poly(oxypropylene) derivatives of ethylene diamine are marketed by BASF Wyandotte Corporation under the trade name of "Tetronics". The total molecular weight of commercially available derivatives fall within the broad molecular weight range of 1650 to over 26,000. One such preferred derivative is "Tetronic 1501" which has an average molecular weight of 7900 and a poly(oxyethylene) content of about 10 percent.

The amount of oxyalkylated alkylphenol-formaldehyde condensation product and tetra poloxyethylene-polyoxypropylene derivative of ethylene diamine added to the lubricating oil should preferably be an amount which is effective in eliminating or substantially reducing the quantity of emulsion sludge when the composition is used as crankcase oil. A useful concentration of oxyalkylated alkylphenol-formaldehyde condensate is about 0.005–0.3 weight percent, more preferably 0.025–0.25 weight percent on an active ingredient basis. Still more preferably, the concentration is 0.05–0.15 weight percent. A useful concentration of tetra poly-oxyethylene polyoxypropylene derivative of ethylene diamine is about 0.001–0.3 weight percent. More preferably, about 0.005–0.05 weight percent.

The additive mixture can be used in both mineral oil and synthetic oil or blends of mineral and synthetic oil. Synthetic oil includes olefin oligomer. These are readily made by the Friedel-Crafts (e.g. $BF_3$—$H_2O$) oligomerization of $C_{6-14}$ α-olefin. An especially useful olefin oligomer is that made by oligomerizing α-decene followed by removal of monomer and dimer and hydrogenation of the residual product.

Another useful class of synthetic oils are the alkylated benzenes. An example of this class is didodecylbenzene. Synthetic ester lubricants are also very useful. These include monoesters, diesters, complex esters and hindered esters. Examples of these are dinonyl adipate, trimethylolpropane tripelargonate and the like.

Blends of about 5–20 percent α-decene trimer with 150 SUS mineral oil form a very useful base lubricant. Likewise, blends of synthetic esters with α-olefin oligomers or alkylated benzenes are useful.

Co-additives are included in the fully formulated crankcase lubricant. Examples of these are dispersants such as the polyisobutenyl succinimide of ethylene polyamine and polyisobutylphenol Mannich condensates with formaldehyde and ethylenepolyamine. Metal detergents such as calcium alkylbenzene sulfonate, magnesium petroleum sulfonate, calcium salicylates, calcium alkylphenates and sulfurized phenates are conventionally included.

Viscosity index improvers are generally added to improve the viscosity property of the formulated oil. These include the polyalkylmethacrylate type and the olefin copolymer type. Examples of the latter are ethylene/propylene copolymer, styrene/butadiene copolymer and the like. Dispersant type VI improvers can also be used such as alkyl methacrylate/N-vinyl pyrrolidone (NVP) copolymers, styrene/alkyl acrylate/N-vinyl pyrrolidone copolymers, alkyl methacrylate/vinyl pyridine copolymers, alkyl methacrylate/dialkylaminoethyl methacrylate copolymers, alkyl methacrylate/hydroxyethyl methacrylate copolymers or olefin copolymers having dispersant properties. These copolymers include random copolymers, block copolymers and graft copolymers. Lubricant compositions may be formulated to contain mixtures of more than one type of VI Improver, such as a mixture of an alkyl methacrylate/N-vinyl pyrrolidone copolymer and of an olefin copolymer.

Phosphosulfurized olefins can be added such as phosphosulfurized terpenes or phosphosulfurized polybutenes. These may be further reacted by steam blowing or by neutralization with alkaline earth metal bases such as barium oxide.

Phenolic antioxidants are frequently added to the oil compositions. Examples of these are 4,4′-methylenebis-(2,6-di-tert-butylphenol), 2,6-di-tert-butyl-4-dimethyl aminomethylphenol, 4,4′-thiobis-(2,6-di-tert-butylphenol) and the like.

Zinc salts of dihydrocarbyldithiophosphoric acid are routinely added to provide both wear and antioxidant protection. A typical example is zinc di-(2-ethylhexyl)-dithiophosphate.

The emulsion sludge problem is most likely to occur in formulated motor oil of the high dispersancy type. By this is meant oils which have the dispersancy required to qualify for API (American Petroleum Institute) classification SE or SF as determined by passing the ASTM Sequence VC or VD test procedure.

Motor oils that pass the VC or VD Sequence tests are often formulated to contain a dispersant type viscosity index improver such as an alkylmethacrylate/N-vinyl pyrrolidone copolymer, a styrene/alkyl acrylate/N-vinyl pyrrolidone copolymer, an alkyl methacrylate/vinyl pyridine copolymer, an alkyl methacrylate/dialkylaminoethyl methacrylate copolymer, an alkyl methacrylate/hydroxyethyl methacrylate copolymer or an olefin copolymer having dispersant properties. Preferably the compositions of the invention are formulated to contain an alkyl methacrylate/N-vinyl pyrrolidone copolymer.

Such high dispersancy can also be obtained by including in the formulated oil an alkenylsuccinic type ashless dispersant. These are made by reacting a polyolefin, (e.g. polyisobutylene) of about 900–5000 molecular weight with maleic anhydride to form an alkenylsuccinic anhydride which is reacted with an amine (e.g. polyalkylenepolyamine such as tetraethylenepentamine). Suitable ashless dispersants are described in U.S. Pat. Nos. 3,172,892 and 3,219,666 among others.

Accordingly, a further preferred embodiment of this invention is a lubricating oil formulated to have the dispersancy required to qualify for API classification SE or SF as determined by passing the ASTM Sequence VC or VD test procedure which contains an emulsion-sludge inhibiting amount of the combination of an oxyalkylated alkylphenol-formaldehyde condensation product and tetra polyoxyalkylene derivative of ethylene diamine as previously described. Test VC is appropriate only for API Classification SE but Test VD may be used for SE or SF.

A further embodiment is such an SE or SF oil which contains a dispersant type viscosity index improver such as an alkylmethacrylate/N-vinyl pyrrolidone copolymer.

A more preferred embodiment of this invention is a lubricating oil formulated as previously described wherein the dispersancy is such as required to qualify for API classification SF as determined by passing the ASTM Sequence VD test procedure.

A still further embodiment is such an SE or SF oil which contains at least 1.5 weight percent, more preferably at least 2.5 weight percent of an alkenylsuccinimide type ashless dispersant measured as active ingredient.

In many cases the additive combination of this invention is first packaged in an additive concentrate formulated for addition to lubricating oil. These concentrates contain conventional additives such as those listed above in addition to the tetra polyoxyalkylated ethylene diamine derivative and alkoxylated alkylphenol-formaldehyde condensate described herein. The various additives are present in a proper ratio such that when a quantity of the concentrate is added to lubricating oil the various additives are all present in the proper concentration to perform their intended function. The additive concentrate also contains a diluent such as mineral oil in order to maintain it in liquid form.

The following examples illustrate the preparation of typical additive concentrates and of typical formulated oils therefrom suitable for use in an engine crankcase.

EXAMPLE 1

Zinc dialkyl dithiophosphate (60.0 lbs), tetronic 1501 (1.0 lb), Prochinor GR 77 (7.5 lbs), a neutral calcium sulfonate (50 lbs), an overbased calcium sulfonate, TBN 300 (75 lbs) and a commercial polyisobutenyl succinimide dispersant concentrate (250 lbs) were compounded in that order to form an additive concentrate. The additive concentrate was dissolved in a solution consisting of an olefin copolymer viscosity index improver (725 lbs) in a 100 VI 150 SN mineral oil (3830 lbs).

EXAMPLE 2

Zinc dialkyl dithiophosphate (60 lbs), Tetronic 1501 (1 lb), Prochinor GR 77 (7.0 lbs), a neutral calcium sulfonate (50 lbs), an overbased calcium sulfonate (75 lbs) and a commercial polyisobutenyl succinimide dispersant concentrate (100 lbs) were compounded in that order to form an additive concentrate. The additive concentrate was dissolved in a solution of an alkyl methacrylate/N-vinyl pyrrolidone copolymer dispersant type viscosity index improver (450 lbs) in a 150 SN mineral oil (4257 lbs).

EXAMPLE 3

Zinc dialkyl dithiophosphate (60.0 lbs), Tetronic 1101 (1.0 lb), Prochinor GR 77 (7.5 lbs), a neutral calcium sulfonate (50 lbs), an overbased calcium sulfonate, TBN 300 (75 lbs) and a commercial polyisobutenyl succinimide dispersant concentrate (250 lbs) were compounded in that order to form an additive concentrate. Tetronic 1101 is a tetra poly(oxyethylene)-poly(oxypropylene) derivative of ethylene diamine of the given formula which has a total molecular weight of 5600 and a poly(oxyethylene) content of about 10 percent by weight based on the total weight of the molecule. The additive concentrate was dissolved in a solution of an alkyl methacrylate/N-vinyl pyrrolidone copolymer dispersant type viscosity index improver (450 lbs) in an 150 SN mineral oil (4527 lbs).

Engine tests were carried out which demonstrate the reduction in emulsion-sludge provided by the present additive combination. In the test an oil blend was used which contained a commercial succinimide ashless dispersant, a zinc dialkyl dithiophosphate, an alkylmethacrylate/N-vinyl pyrrolidone copolymer VI improver, a 300 TBN overbased calcium alkylbenzene sulfonate and a neutral calcium alkylbenzene sulfonate.

The engine used was a 4-cylinder Ford Cortina with an 8.3:1 compression ratio built as described in CEC method L-03-A-70, modified in that the oil sump and rocker cover were jacketed to provide water cooling. A condenser was fitted into the oil fill opening and the crankcase breather was blocked off. After the engine was cleaned by running with a flushing oil, the test oil was placed in the crankcase. The engine was operated for 16 hours at 2750 rpm. The rocker cover was then removed and rated for quantity of emulsion-sludge using the CRC rating system on a scale from −3.9 to 10 (10=clean).

The following results were obtained:

| Additive | Conc. | Rating |
|---|---|---|
| None | — | 3.1 |
| Tetronic 1501 | 0.02 | 5.6 |
| Tetronic 1501 | 0.03 | 5.8 |
| Prochinor GR77 | 0.10 | 4.8 |
| Prochinor GR77 | 0.15 | 6.5 |
| Tetronic 1501 | 0.02 | 7.2 |
| Prochinor GR77 | 0.08 | |
| Tetronic 1501 | 0.02 | 8.0 |
| Prochinor GR77 | 0.15 | |

These results show that the combination of poly oxyalkylene derivative of ethylene diamine (Tetronic 1501) with oxyalkylated alkylphenol-formaldehyde condensate (Prochinor GR77) gave a significant improvement in emulsion-sludge rating compared to the ratings obtained using either the poly oxyalkylene derivative of ethylene diamine (Tetronic 1501) or the oxyalkylated alkylphenol-formaldehyde condensate (Prochinor GR77) individually.

We claim:

1. A lubricating oil composition comprising a major amount of lubricating oil and a minor emulsion-sludge inhibiting amount of the combination of (a) an oxyalkylated alkylphenol-formaldehyde condensation product and (b) a tetrapoly(oxyethylene)-poly(oxypropylene) derivative of ethylene diamine.

2. A composition of claim 1 wherein said oxyalkylated alkylphenolformaldehyde condensation product has the formula

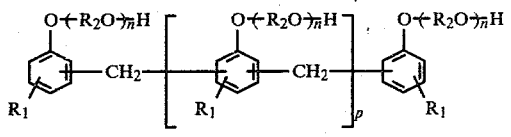

wherein $R_1$ is an alkyl group containing about 5 to 20 carbon atoms, $R_2$ is a divalent aliphatic hydrocarbon group containing 2 to 3 carbon atoms, the values of n are each integer independently selected from 1 to 20 and p is an integer from 0 to about 20.

3. A composition of claim 2 wherein n is an integer from 2 to 10 and p is an integer from 7 to 12 and n and p are selected such that the molecular weight of said condensation product is about 4000–6000.

4. A composition of claim 3 wherein $R_1$ is a nonyl group and $R_2$ is the ethylene group, $—CH_2CH_2—$.

5. A composition of claim 1 wherein said tetrapolyoxyalkylene derivative of ethylene diamine has the structure

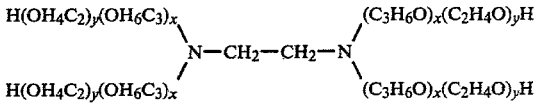

wherein x and y are integers independently selected such that the collective average molecular weight range of the polyoxypropylene hydrophobic blocks is 500–7000, and the collective average molecular weight of the polyoxyethylene hydrophylic blocks is 10–80 weight percent of the total molecule.

6. A composition of claim 5 wherein the total average molecular weight of said derivative is about 5000–12,500 and y is selected such that the poly(oxyethylene) content of said hydrophylic blocks is about 10–40 percent by weight of the total molecule.

7. A composition of claim 6 wherein the total average molecular weight of said derivative is about 7000–10,000 and y is selected such that the poly(oxyethylene) content of said hydrophylic blocks is about 10–20 percent by weight of the total molecule.

8. A composition of claim 2 wherein said tetrapolyoxyalkylene derivative of ethylene diamine has the structure

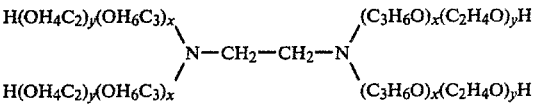

wherein x and y are integers independently selected such that the collective average molecular weight range of the polyoxypropylene hydrophobic blocks is 500–7000, and the collective average molecular weight of the polyoxyethylene hydrophylic blocks is 10–80 weight percent of the total molecule.

9. A composition of claim 8 wherein n is an integer from 2–10, p is an integer from 7–12 and n and p are selected such that the molecular weight of said condensation product is about 4000–6000.

10. A composition of claim 9 wherein $R_1$ is a nonyl group, $R_2$ is the ethylene group, $—CH_2CH_2—$, x and y are selected such that the total average molecular weight of said derivative is 5000–12,500 and the poly-(oxyethylene) content of said hydrophylic group is about 10–40 percent by weight of the total molecule.

11. A composition of claim 1 further containing an alkenyl succinimide ashless dispersant.

12. An additive concentrate adapted for addition to lubricating oil to provide a formulated lubricating oil suitable for use in the crankcase of an internal combustion engine, said concentrate containing an amount sufficient to inhibit emulsion-sludge when said formulated lubricating oil is used in said engine of (a) an oxyalkylated alkylphenol-formaldehyde condensation product, and (b) a tetra-poly(oxyethylene)-poly(oxypropylene) derivative of ethylene diamine.

* * * * *

UNITED STATES PATENT AND TRADEMARK OFFICE

CERTIFICATE OF CORRECTION

PATENT NO. : 4, 305, 834

DATED : December 15, 1981

INVENTOR(S) : Rodney I. Barber et al

It is certified that error appears in the above-identified patent and that said Letters Patent are hereby corrected as shown below:

Cover page: "(73) Assignee: Ethyl Corporation
Richmond, Va."

should be

-- (73) Assignee: Edwin Cooper and Company
Limited
Bracknell, England --

Signed and Sealed this

***Twenty-seventh* Day of *July 1982***

[SEAL]

*Attest:*

GERALD J. MOSSINGHOFF

*Attesting Officer*

*Commissioner of Patents and Trademarks*